US011473300B2

(12) United States Patent
Simek et al.

(10) Patent No.: US 11,473,300 B2
(45) Date of Patent: Oct. 18, 2022

(54) SYSTEMS AND METHODS FOR A CAST-IN ANCHOR FOR A METAL DECK

(71) Applicant: HILTI AKTIENGESELLSCHAFT, Schaan (LI)

(72) Inventors: Philipe Simek, Lantana, TX (US); Matteo Spampatti, Buchs (CH)

(73) Assignee: HILTI AKTIENGESELLSCHAFT, Schaan (LI)

( * ) Notice: Subject to any disclaimer, the term of this patent is extended or adjusted under 35 U.S.C. 154(b) by 25 days.

(21) Appl. No.: 17/254,420

(22) PCT Filed: Jul. 11, 2019

(86) PCT No.: PCT/EP2019/068672
§ 371 (c)(1),
(2) Date: Dec. 21, 2020

(87) PCT Pub. No.: WO2020/016093
PCT Pub. Date: Jan. 23, 2020

(65) Prior Publication Data

US 2021/0123238 A1 Apr. 29, 2021

Related U.S. Application Data

(60) Provisional application No. 62/699,298, filed on Jul. 17, 2018.

(51) Int. Cl.
*E04B 9/18* (2006.01)
*E04B 1/41* (2006.01)

(52) U.S. Cl.
CPC ..... *E04B 9/18* (2013.01); *E04B 1/4121* (2013.01)

(58) Field of Classification Search
CPC ..... E04B 9/18; E04B 1/4121
See application file for complete search history.

(56) References Cited

U.S. PATENT DOCUMENTS

| | | | | |
|---|---|---|---|---|
| 3,391,514 | A | 7/1968 | Hall, Jr. | |
| 4,179,151 | A | 12/1979 | Tye | |
| 5,428,936 | A * | 7/1995 | Roth | E04B 1/4157 248/327 |
| 6,240,697 | B1 * | 6/2001 | Thompson | E04B 1/4121 52/707 |
| 6,789,364 | B2 * | 9/2004 | Popovich | E04B 9/18 52/745.1 |
| 7,093,400 | B1 * | 8/2006 | Thompson | E04B 9/18 52/704 |

(Continued)

FOREIGN PATENT DOCUMENTS

WO WO 2014/031647 A1 2/2014

OTHER PUBLICATIONS

International Search Report in International Application No. PCT/NO2019/068672, dated Sep. 27, 2020.

*Primary Examiner* — Andrew J Triggs
(74) *Attorney, Agent, or Firm* — Leydig, Voit & Mayer, Ltd.

(57) ABSTRACT

A system includes an anchor body comprising a head and a hollow chamber shaft coupled to the head. The system also includes a housing sleeve configured to support the anchor body. The housing sleeve includes one or more fasteners pre-threaded into a base of the housing sleeve, and the housing sleeve comprises an arch configured to adapt to a ridge of a metal deck.

14 Claims, 5 Drawing Sheets

(56) References Cited

U.S. PATENT DOCUMENTS

| | | | | |
|---|---|---|---|---|
| 8,267,628 | B2 * | 9/2012 | Noce | E04B 5/40 411/80.6 |
| 2015/0184372 | A1 | 7/2015 | Wright | |
| 2020/0248444 | A1 * | 8/2020 | Spampatti | E04B 1/4121 |
| 2021/0123238 | A1 * | 4/2021 | Simek | E04B 9/18 |

* cited by examiner

SYSTEMS AND METHODS FOR A CAST-IN ANCHOR FOR A METAL DECK

CROSS-REFERENCE TO RELATED APPLICATIONS

This patent application is the U.S. National Stage of International Patent Application No. PCT/EP2019/068672, filed Jul. 11, 2019, which claims the benefit of U.S. Patent Application No. 62/699,298, filed Jul. 17, 2018, which are each incorporated by reference.

BACKGROUND

The present disclosure relates generally to the field of anchoring systems, and more particularly to anchoring systems assembled within a deck. Specifically, the present embodiments are related to anchoring systems that are utilized to fasten various construction elements to the deck.

In typical construction sites, deck construction (e.g., decking) is often utilized to build the floors and ceilings of multiple story buildings. In such buildings, anchoring systems may be installed to suspend various construction elements (e.g., pipes, sprinkler systems, HVAC components, trays and conduits, electrical elements, mechanical elements, nonstructural elements, etc.) from the ceiling. In certain situations, the anchoring systems may be positioned during the construction of the deck, before concrete is poured. For example, a wood form, a fluted, and/or a corrugated metal sheet of alternating peaks and valleys may be installed as a base. Further, various anchoring systems are positioned throughout the deck based on the desired function and position of the construction elements that the anchoring systems are configured to support within the building. After the anchoring systems are properly positioned and fastened to the base, concrete is poured and cured over the base, thereby securing and embedding the anchoring system. After formation of the deck (e.g., the floors and ceilings of the building), a male or female connection may be threaded into the anchoring system to securely suspend or fasten the construction element from the ceiling.

In certain situations, it may be difficult to position the anchoring system in a desired location on the base, at least in part due to the uneven surfaces and structure of the base. For example, in a corrugated metal sheet of alternating peaks and valleys, the valley may include one or more ridges or protrusions that may have to be avoided when fastening the anchoring system to the base. Such restrictions may limit the flexibility of the anchoring system and/or the construction elements subsequently secured to the anchoring system. Further, after formation of the deck and prior to a threaded connection coupled to the anchoring system, the ceiling may be prepared with additional components (e.g., firestop applications, insulation, etc.). In certain situations, during application of these components, features of the anchoring system may be inadvertently covered, thereby making it difficult to insert and coupled the threaded connection to the anchoring system. Accordingly, it may be beneficial to design an anchoring system that improves these and other concerns, such that it is efficient to install and easy to use.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In a first embodiment, a system includes an anchor body comprising a head and a hollow chamber shaft coupled to the head. The system also includes a housing sleeve configured to support the anchor body. The housing sleeve includes one or more fasteners pre-threaded into a base of the housing sleeve, and the housing sleeve comprises an arch configured to adapt to a ridge of a metal deck.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
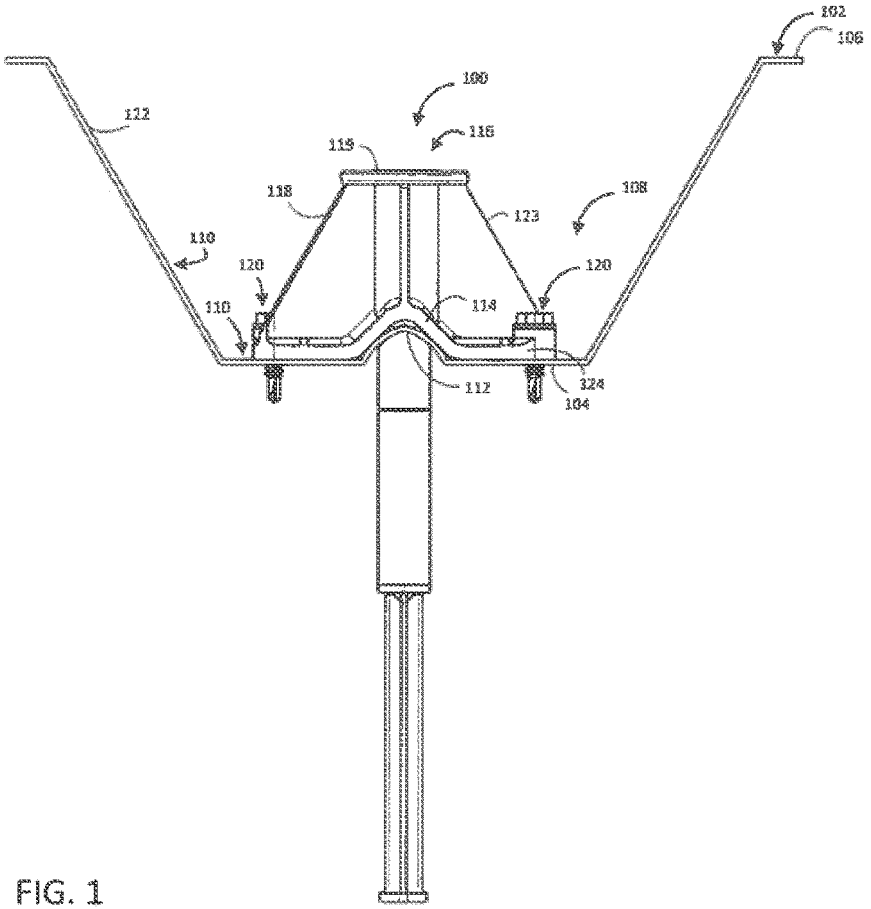
FIG. 1 is a perspective view of an embodiment of the anchoring system having an anchor body disposed within a housing, where the anchoring system is fastened on a ridge disposed on a valley of a metal deck.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

Present embodiments are directed to anchoring systems, and more specifically, for anchoring systems utilized in decks during the construction of floors and ceilings of multistory buildings. Specifically, the present embodiments are directed to anchoring systems that are configured to improve efficiency in installation and ease of use during deck construction. The anchoring system may be a cast-in anchor system (e.g., an anchoring system or anchor system) that is pre-installed to a metal deck before concrete is poured and cured. Subsequently, a construction element (pipes, sprinkler systems, HVAC components, trays and conduits, electrical elements, mechanical elements, nonstructural elements, etc.) may be coupled to the anchor system for various electrical, mechanical, plumbing, or other applications.

In certain embodiments, the anchor system may include an anchor body disposed within a housing sleeve. Specifically, the anchor body may include a head and a hollow chamber having one or more different thread sizes (e.g., multi-thread component). In certain embodiments, the construction element may be coupled to the anchoring system via a male/female threaded connection to the multi-thread component. In certain embodiments, the housing sleeve is configured to support the hollow chamber of the anchor body, and may be secured to the deck via one or more self-tapping screws. In certain embodiments, the housing sleeve may include a detachable elongated tube that extends the hollow chamber, and guides the male/female threaded connection to the multi-thread component. In certain embodiments, the elongated tube protects the opening to the hollow chamber from post-installation application of fire-stop materials, insulation, etc. to the underside of the metal deck. Further, in certain embodiments, a removable plug may be additionally provided for protection from materials that may potentially cover the opening to the multi-thread component, thereby making it easier for an installer to find the opening through the added materials. These and other features are further described with respect to FIGS. 1-6 below.

Turning now to the drawings, FIG. 1 is a perspective view of an embodiment of the anchoring system 100 pre-installed on a metal deck 102. In certain embodiments, the pre-installation process may refer to a period of time during construction during which the anchoring system 100 is positioned on the deck and before concrete is poured. In certain embodiments, the metal deck 102 may be a corrugated sheet metal having alternating valley (e.g., a valley 104) and peak (e.g., a peak 106) regions, and may be utilized in horizontal ceiling applications. The metal deck 102 may be cast in concrete on-site, such that the corrugated sheet metal remains on the lower side of the ceiling. The gaps between each valley 104 and peak 106 create one or more flutes 108 that run the length of the metal deck 102. In certain embodiments, the flutes 108 have features that protrude from and/or indent into the inner surface 110. For example, the features may be ridges, valleys, depressions, protrusions, grooves, embossments, cavities, contours, etc. In certain situations, the features of the metal deck 102 may make it difficult and/or pose limitations for an installer to position various anchoring systems flat on the inner surface 110. Further, the shape of the metal deck 102 (e.g., angled region 122) may make it difficult and/or pose limitations for an installer to position various anchoring systems on the region between the valley 104 and the peak 106. Accordingly, there is a need for anchoring systems that may be flexibly positioned on certain features of the metal deck 102.

In certain embodiments, the anchoring system 100 includes an anchor body 116 supported by a housing sleeve 118. Particularly, the anchor body 116 may include a head 119 and a hollow chamber (illustrated in FIGS. 3 and 4) that is configured to receive a male/female threaded connection post-installation of the anchoring system 100. In certain embodiments, the housing sleeve 118 includes various components that provide support for the hollow chamber of the anchor body 116. For example, the housing sleeve 118 may include a cylindrical space 121 configured to receive the hollow chamber of the anchor body 116. Further, the housing sleeve 118 may include one or more wings 123 that extend from a foundation 124 to below the head 119 of the anchor body 116. In certain embodiments, the head 119 of the anchor body 116 may be flush with the top of the housing sleeve 118. The wings 123 may be configured to provide structural support to the anchor body 116 during transportation as well as during the pre-installation process. Specifically, during the pre-installation process, when the anchoring system 100 is fastened to the metal deck 102, the anchoring system 100 may be configured to withstand one or more impacts that help secure the housing sleeve 118 to the metal deck 102.

As shown in the illustrated embodiments, embodiments of the anchoring system 100 allow the anchoring system 100 to be disposed directly on top of certain features on the metal deck 102. For example, anchoring system 100 may be configured to sit on a ridge 112 within the valley 104 of the metal deck 102. The ridge 112 may run the length of the flute 108, and may protrude away from an inner surface 110 of the valley 104. In certain embodiments, the housing sleeve 118 may include an arch 114 that is configured to adapt to the shape of the ridge 112. In particular, the arch 114 of the housing sleeve 118 allows the anchoring system 100 to be positioned at any desired location on the inner surface 110—including on top of the ridge 112. While the anchoring system 100 may be positioned on the ridge 112 if desired, the anchoring system 100 may additionally be positioned on any flat surface, such as the spaces between the ridge 112 and the angled region 122 and/or on the angled region 122. In this manner, the arch 114 may provide additional flexibility for the anchoring system 100 by allowing for a greater range of use on the metal deck 102. Furthermore, in certain embodiments, when the anchoring system 100 is pre-installed on the ridge 112, the arch 114 may provide additional support to the structure of the anchoring system 100, thereby helping to reduce accidental displacement during the pre-installation process.

In certain embodiments, the housing sleeve 118 may be fastened to the deck 102 during the pre-installation process via one or more self-tapping screws 120. As further described with respect to FIG. 2, the self-tapping screws 120 may be configured to secure the housing sleeve 118 (and thereby the anchoring system 100) to the deck 102.

Figure 2:
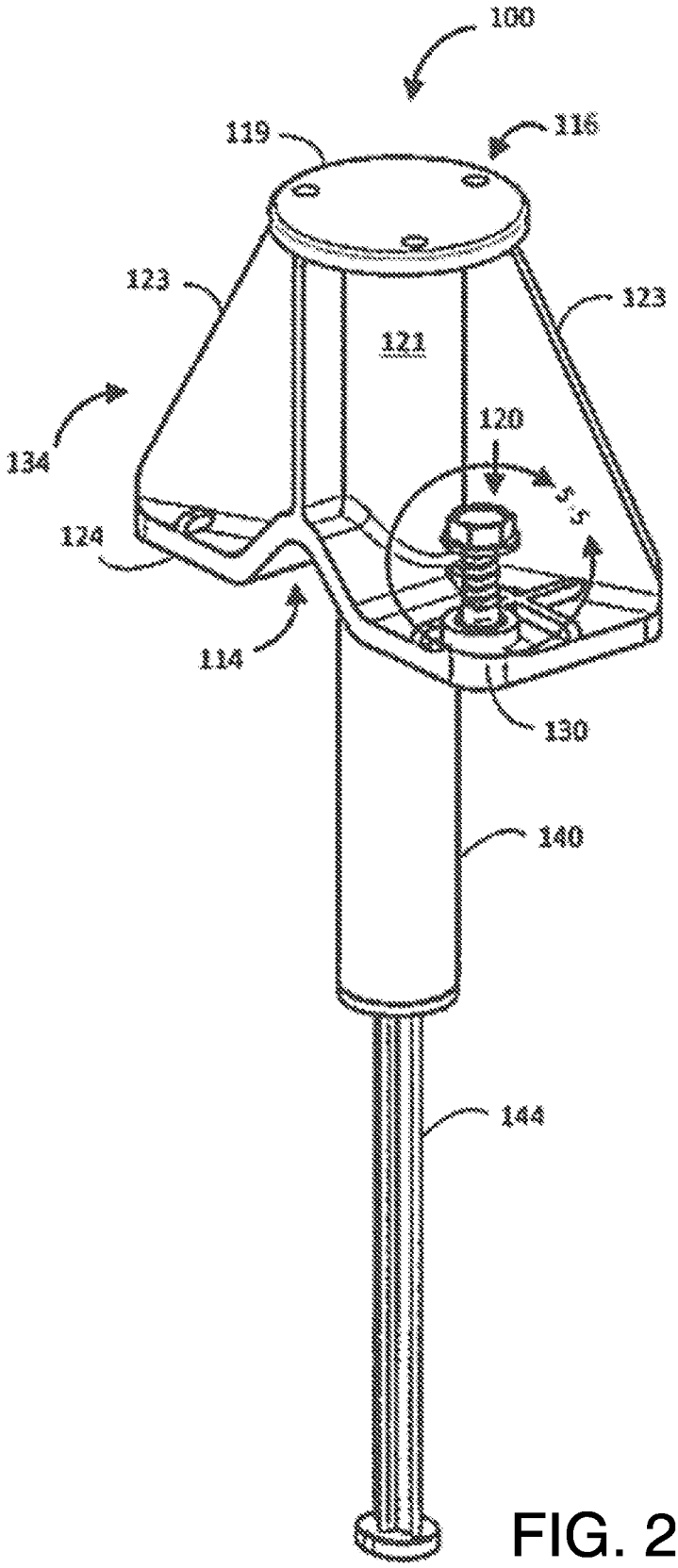
FIG. 2 is a perspective view of an embodiment of the anchoring system of FIG. 1, where the housing includes a arch configured to adapt to the ridge of the metal deck and a detachable tube configured to receive a threaded connection.

FIG. 2 is a perspective view of an embodiment of the anchoring system 100 of FIG. 1, where the housing sleeve 118 includes the arch 114 configured to adapt to the ridge 112 of the metal deck 102. Further, in certain embodiments, the housing sleeve 118 includes one or more self-tapping screws 120 that may be utilized by the operator/installer to secure the housing sleeve 118 to the deck 102 during the pre-installation process.

Specifically, the self-tapping screws 120 may be configured to fit into a raised aperture 130 that extends from the housing sleeve 118. In the illustrated embodiment, two self-tapping screws 120 are disposed on the housing sleeve 118 at opposite ends (e.g., a first end 132 opposite a second end 134). In particular, the two self-tapping screws 120 may be disposed off-set from one another on the housing sleeve 118 to help stabilize the housing sleeve at the opposite ends. Indeed, the location of the self-tapping screws 120 may help to increase the kick-over resistance of the anchoring system 100, thereby reducing the need for an operator/installer to re-install the anchoring system 100 on the deck 102 due to possible user error during the pre-installation process. In certain embodiments, it should be noted that any number of self-tapping screws 120 may be utilized within the housing sleeve 118 to secure the housing sleeve 118 to the metal deck 102. For example, in certain embodiments, four (4) self-tapping screws 120 may be disposed on the housing sleeve 118, such that a single self-tapping screw 120 is disposed at each corner of the housing sleeve 118. In other embodiments, 1, 3, 5, 6, 7, 8, 9, 10 or more self-tapping screws 120 may be utilized on the housing sleeve 118 at various locations.

In certain embodiments, the self-tapping screws 120 are pre-installed into the raised aperture 130 of the housing sleeve 118. In certain embodiments, during the transportation process, the anchoring systems 100 may include the self-tapping screws 120 removably secured (e.g., partially threaded) to the raised aperture 130 of the housing sleeve 118. In such embodiments, the installer may not need to procure and/or mount the self-tapping screw 120 to the housing sleeve 118. Indeed, the self-tapping screw 120 may already be mounted to the raised aperture 130 of the housing sleeve 118, as further described with respect to FIG. 5. In this manner, the anchoring system 100 may help improve efficiency during the pre-installation process. In certain embodiments, the housing sleeve 118 may include the raised aperture 130, but the self-tapping screw 120 may not come pre-mounted to the housing sleeve 118.

In certain embodiments, the self-tapping screws 120 may be securely fastened to the metal deck 102 (from the pre-mounted state described above) with a combo bit tool. Specifically, the combo bit tool may be configured to improve the efficiency of the installation of the anchoring system 100 by combining the tools necessary to drill a hole into the metal deck 102 as well as secure the self-tapping screws 120 to the metal deck 102. The embodiments and features of the combo bit tool are further described in detail in U.S. Provisional Patent Application 62/699,355, filed on Jul. 17, 2018, which is hereby incorporated by reference in full.

Figure 3:
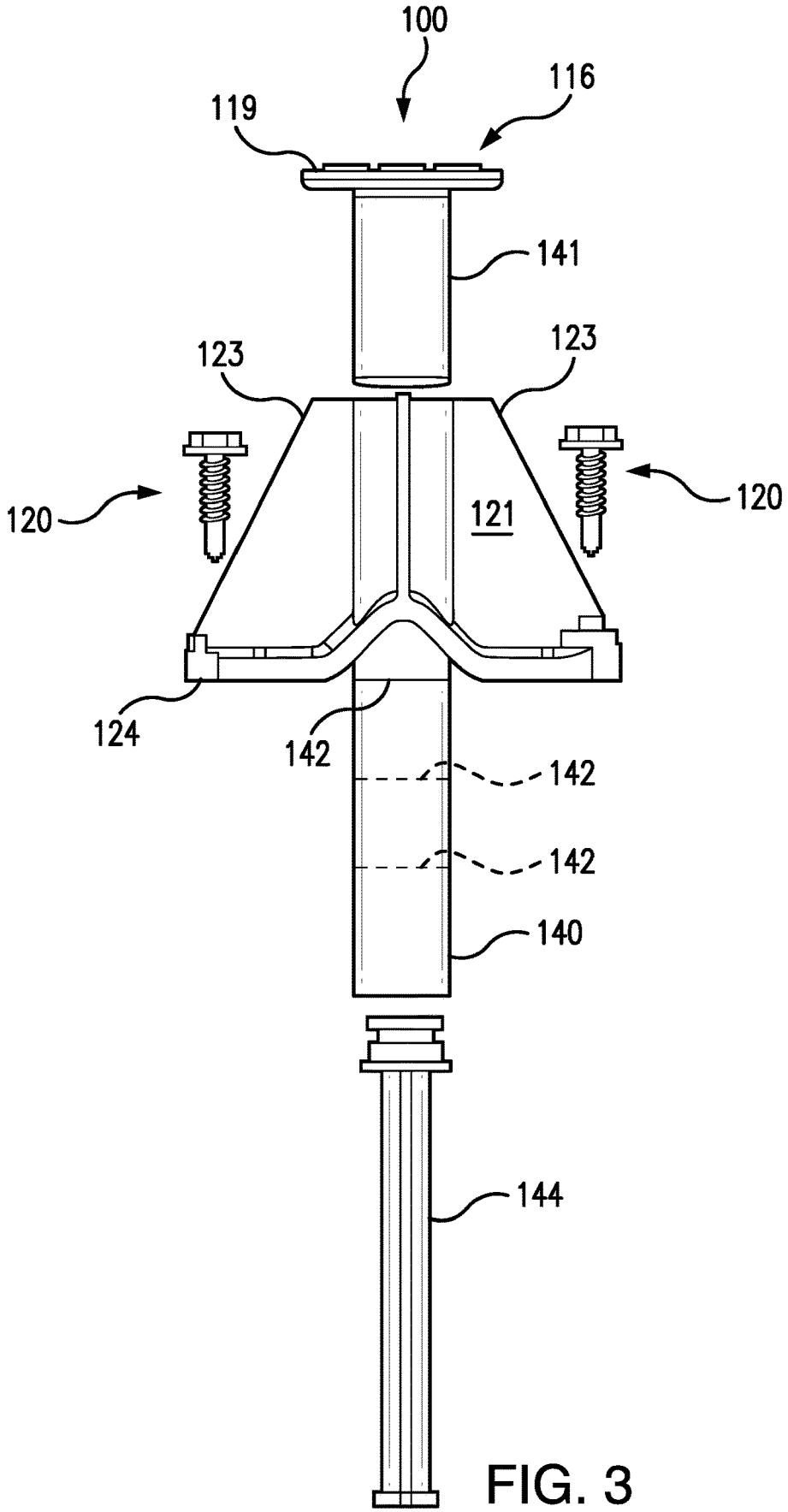
FIG. 3 is an expanded view of an embodiment of the anchoring system of FIG. 1, where the housing is configured to receive one or more self-tapping screws and a removable plug.

Further, in certain embodiments, the housing sleeve 118 includes a detachable tube 140 configured to receive a threaded male/female connection after installation of the anchoring system 100, as further described with respect to FIG. 3.

FIG. 3 is an expanded view of an embodiment of the anchoring system 100 of FIG. 1, where the housing sleeve 118 includes a detachable tube 140 configured to receive a male/female threaded connection after installation of the anchoring system 100. As noted above, after the anchoring systems 100 are properly positioned and fastened to the base during the pre-installation process, concrete is poured and cured over the deck 102, thereby securing and embedding the anchoring system 100. After formation of the deck 102 (e.g., the floors and ceilings of the building), a male/female connection may be threaded into the anchoring system 100 to securely suspend or fasten a construction element (e.g., pipes, sprinkler systems, HVAC components, trays and conduits, electrical elements, mechanical elements, non-structural elements, etc.) from the ceiling.

In certain situations, after the formation of the deck 102, and before threaded connections are coupled to the anchoring systems 100, additional components may be added to the exposed underside (e.g., ceiling) of the metal deck 102. For example, in certain situations, the ceiling may be prepared with additional components (e.g., firestop applications, insulation, etc.) via spray, paint, or other types of manual applications. In certain situations, during application of these components, features of the anchoring system 100 exposed on the underside (e.g., access to the inner chamber of the anchor body 116) may be inadvertently covered, thereby making it difficult to insert and couple the construction element to the anchoring system 100. Accordingly, in certain embodiments, it may be beneficial to have the detachable tube 140 configured to extend access to the inner chamber of the anchor body 116, as further described in detail below.

In particular, in certain embodiments, the tube 140 may be formed of any material (e.g., plastic, metal, etc.) and may be an extension of the cylindrical space 121 configured to receive the hollow chamber 141 of the anchor body 116. In certain embodiments, the length of the tube 140 may be designed to suit the needs of the anchoring system 100. For example, for applications to the ceiling that are thicker, a longer tube 140 may be utilized with the anchoring system 100. For applications to the ceiling that are thinner, a shorter tube 140 may be utilized with the anchoring system 100. In certain embodiments, the anchoring system 100 may not include any tube 140, when no extension is deemed useful. In certain embodiments, the tube 140 may include a perforation 142 which may allow an installer to remove the tube 140 at any point. In certain embodiments, the tube 140 may include two or more perforations 142, which may allow the installer to select a tube 140 length that is appropriate for the construction process. It should be noted that the metal body 116 (e.g., anchor body 116) is above the metal deck 102. Specifically, after installation, the metal body 116 (e.g., anchor body 116) is disposed on or above the valley 104 of the metal deck 102. Accordingly, in certain embodiments, the installer may break the tube 140 flush against the bottom surface of the metal deck 102 via the perforation 142 that is proximate to the bottom surface of the metal deck 102.

In certain embodiments, the anchoring system 100 may include a plug 144 (e.g., plunger) that is configured to adapt to the opening of the tube 140. The plug 144 may be configured to provide additional extension for the tube 140, to further help reduce an amount of firestop application, insulation, spray, paint, or other types of manual applications from entering the inner chamber of the anchor body 116. In certain embodiments, the plug 144 may be formed of any flexible material (e.g., rubber, foam, etc.) and may include one or more visual indicators (e.g., text, color, numbers, letters, etc.) that serve to categorize the size, type, function, or intended use of the anchoring system 100. For example, in certain embodiments, the plug 144 may be one or more different colors, where each color is representative of a different anchor size. As a further example, in certain embodiments, the plug 144 may be one or more different colors, where each color is representative of a different intended use (e.g., electrical, mechanical, plumbing, or other applications) for the anchoring system 100. As a further example, in certain embodiments, the plug 144 may include one or more different letters/numbers, where the text indicates to an installer various pieces of information (e.g., size, intended use, installation date or time, installer ID, etc.). Accordingly, an installer may remove the plug 144 prior to inserting, threading and coupling a male/female connection into the inner chamber of the anchor body 116, as further described in detail below.

Figure 4:
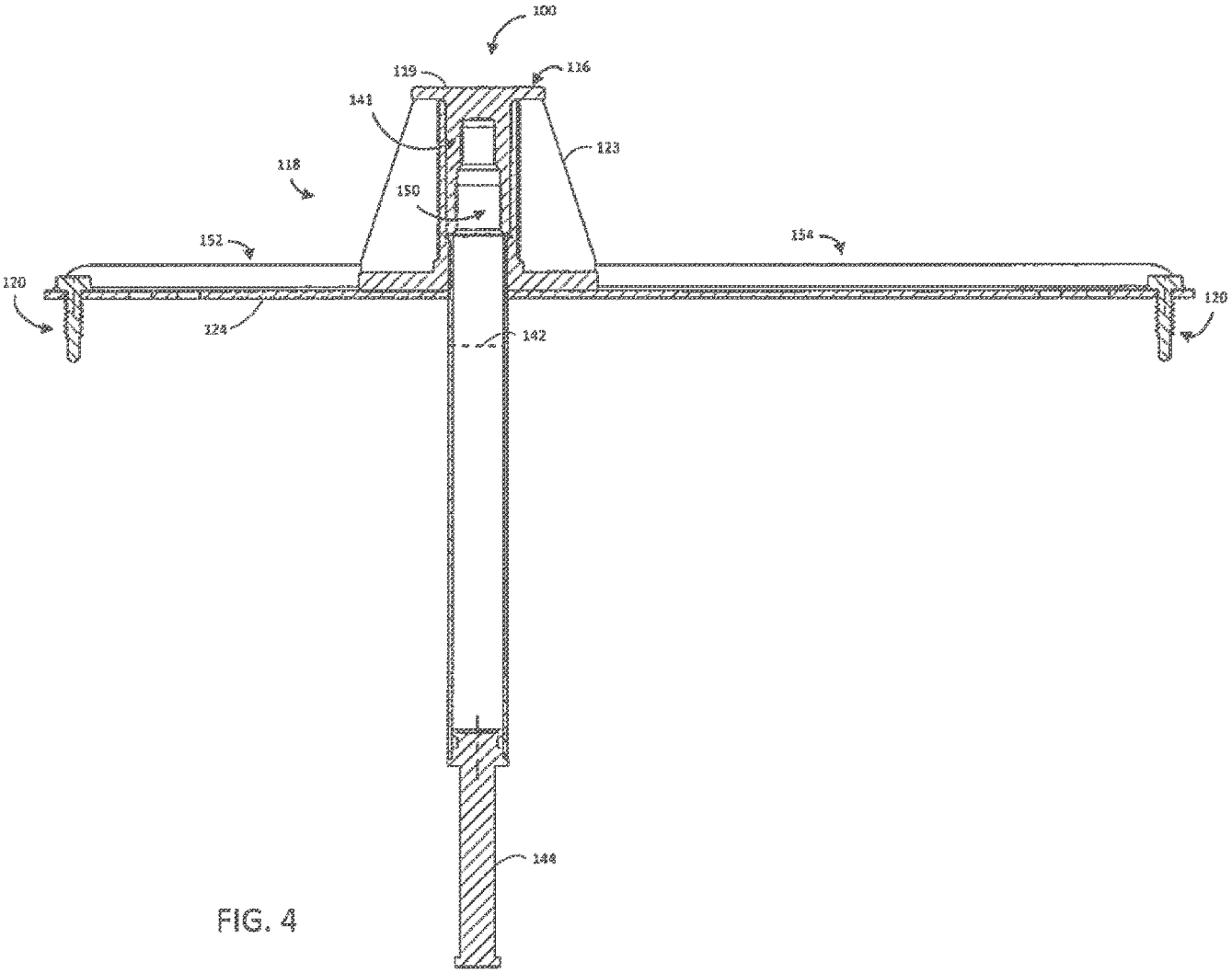
FIG. 4 is a cross-sectional view of an embodiment of the anchoring system of FIG. 1, where the anchor body of the anchoring system includes a multi-thread component.

FIG. 4 is a cross-sectional view of an embodiment of the anchoring system 100 of FIG. 1, where the anchor body 116 of the anchoring system 100 includes a multi-thread component 150. In particular, the multi-thread component 150 may have one or more continuous threads of different sizes.

The multi-thread component 150 may be configured to receive construction elements having threaded connection of different sizes, thereby increasing the flexibility of the cast-in anchor. For example, the threads may be configured as: ¼"-⅜", ⅜"-½", ⅜"-½"-⅝", ½"-⅝"-¾", ⅜"-½"-⅝"-¾" and/or ⅝"-¾". Accordingly, in certain situations, the construction element may be threaded into a desired sized of the multi-thread component 150. The multi-thread component 150 may include diameters of any size and may employ any different combinations of sizes. In certain embodiments, the multi-thread component 150 may include an automatic clamping mechanism having one or more different sizes. The automatic clamping mechanism may allow a construction element to be pushed into a desired size of the multi-thread component 150, thereby increasing time and efficiency during the installation process.

In certain embodiments, the housing sleeve 118 includes various components that provide support for the hollow chamber of the anchor body 116. For example, the housing sleeve 118 may include one or more wings 123 that extend from a foundation 124 to below the head 119 of the anchor body 116. Further, in certain embodiments, the housing sleeve 118 may include two plates on either end of the cylindrical portion 121. The plates may form the foundation 124, which may support the housing sleeve 118 against the flat surface of the inner surface 110. In certain embodiments, the plates may be a short plate 152 and/or a long plate 154. In particular, the long plate 154 may be configured to extend a distance further than the short plate 152. In certain embodiments, the long plate 154 may be configured to support the anchoring system 100 between the flutes, and may be formed of any material (e.g., metal, plastic, etc.). In certain embodiments, the long plate 154 may be an extension of the housing sleeve 118 (e.g., plastic), while in other embodiments, the long plate 154 may be a different component and/or material (e.g., metal) than the housing sleeve 118.

Figure 5:
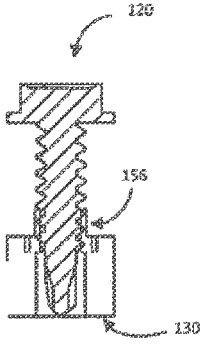
FIG. 5 is a cross-sectional view of an embodiment of the one or more self-tapping screws of FIG. 2.

FIG. 5 is a cross-sectional view of an embodiment of the one or more self-tapping screws 120 of FIG. 2. As noted above, the self-tapping screws 120 may be pre-installed to fit into a raised aperture 130 that extends from the housing sleeve 118. In certain embodiments, during the transportation process, the anchoring systems 100 may include the self-tapping screws 120 removably secured (e.g., partially threaded) to the raised aperture 130 of the housing sleeve 118. In such embodiments, the installer may not need to procure and/or mount the self-tapping screw 120 to the housing sleeve 118. In certain embodiments, the raised aperture 130 include a tab 156 that is configured to provide additional support to the partially threaded self-tapping screw 120. Further, when the self-tapping screw 120 is installed into the deck 102, the tab 156 may be configured to break away, thereby providing support for the self-tapping screw 120 without any resistance. In certain embodiments, the tab 156 may be thinner than the raised aperture 130, and may be easily broken away when the self-tapping screw 120 in inserted into the deck 102.

Figure 6:
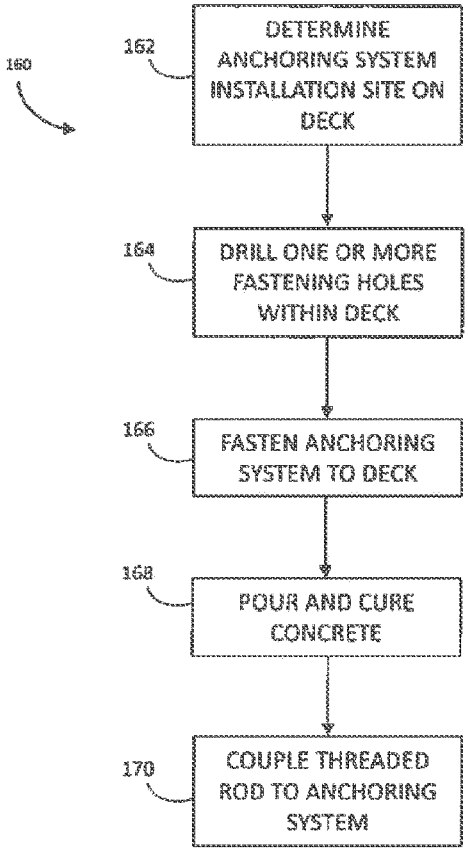
FIG. 6 is an embodiment of a method to couple a threaded connection to an anchoring system installed on a deck.

FIG. 6 is an embodiment of a method 160 to couple a male/female threaded connection to an anchoring system 100 installed on the metal deck 102. In certain embodiments, the method 160 includes determining an installation site on the metal deck 102 for the anchoring system 100 (block 162). In particular, the location of the installation site may be determined by the desired location of the installed construction element (e.g., pipes, sprinkler systems, HVAC components, trays and conduits, electrical elements, mechanical elements, nonstructural elements, etc.) from the ceiling.

In certain embodiments, the method 160 includes drilling one or more fastening holes within the deck (block 164). For example, in certain embodiments, a combo bit tool may be configured to drill a hole within the metal deck 102 that is sized to fit the cylindrical body 121 (and/or the tube 140, and/or the plug 144). In certain embodiments, any tool designed to drill holes within the metal deck 102 may be utilized. Further, after the hole is formed, a portion of the anchoring system 100 may be inserted into the formed hole, and the combo bit tool may be utilized to fasten the anchoring system 100 to the metal deck 102 (block 166). Specifically, the self-tapping screws 120 may be securely fastened to the metal deck 102 (from the pre-mounted state described above). In certain embodiments, the same combo bit tool configured to drill holes within the metal deck 102 may be utilized to fasten the anchoring system 100 to the metal deck 102. The combo bit tool may be configured to improve the efficiency of the installation of the anchoring system 100 by combining the tools necessary to drill a hole into the metal deck 102 as well as secure the self-tapping screws 120 to the metal deck 102. The embodiments and features of the combo bit tool are further described in detail in U.S. Provisional Patent Application 62/699,355, filed on Jul. 17, 2018, which is hereby incorporated by reference in full.

In certain embodiments, the method 100 includes pouring and curing the concrete onto the anchoring systems 100 installed into the metal deck 102 (block 168). Further, the method includes coupling a male/female threaded connection to the anchoring system 199 (block 170). In this manner, the anchoring system 100 may be utilized as a cast-in anchor system (e.g., the anchoring system 100 or anchor system) that is pre-installed to the metal deck 102 for construction element (pipes, sprinkler systems, HVAC components, trays and conduits, electrical elements, mechanical elements, nonstructural elements, etc.) utilized for various electrical, mechanical, plumbing, or other applications.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A system, comprising:

an anchor body comprising a head and a hollow chamber shaft coupled to the head, wherein the anchor body is above a valley of a metal deck; and a housing sleeve configured to support the anchor body, wherein the housing sleeve comprises one or more fasteners pre-threaded into a base of the housing sleeve, and a detachable elongated tube, wherein the detachable elongated tube extends the hollow chamber shaft, and the detachable elongated tube comprises one or more perforated portions, wherein each of the one or more perforated portions is removable to shorten the hollow chamber shaft, and wherein the housing sleeve comprises an arch configured to adapt to a ridge of the metal deck.

2. The system of claim 1, wherein the hollow chamber shaft comprises a multi-thread component comprising two or more threads of varying diameters configured to engage a male threaded connection.

3. The system of claim 2, wherein a construction element is configured to couple to the anchor body via the male threaded connection.

4. The system of claim 3, wherein the construction element comprises pipes, sprinkler systems, HVAC components, conduits, electrical elements, plumbing elements, mechanical elements, or any combination thereof.

5. The system of claim 1, comprising a plug to close an opening to the hollow chamber shaft in the detachable elongated tube.

6. The system of claim 5, wherein the plug comprises a visual indicia configured to uniquely identify the system, and wherein the visual indicia comprises a color, a text, a number, or a combination thereof.

7. The system of claim 1, wherein the housing sleeve comprises a plate to extend a foundation of the housing sleeve.

8. The system of claim 7, wherein the plate is a plate configured to extend the foundation of the housing sleeve to bridge a distance between two peaks of the metal deck.

9. The system of claim 7, wherein the plate is a plate configured to extend the foundation of the housing sleeve to cover a distance within the valley of the metal deck.

10. The system of claim 1, wherein the one or more fasteners are self-tapping screws.

11. The system of claim 1, wherein the one or more fasteners are pre-threaded into a raised aperture within the base of the housing sleeve.

12. The system of claim 11, wherein the one or more fasteners are partially pre-threaded into the base of the housing sleeve prior to installation or use.

13. The system of claim 12, wherein the raised aperture comprises a support tab configured to provide support for the one or more partially pre-threaded fasteners.

14. The system of claim 13, wherein the support tab is configured to break away or snapped off when the one or more partially pre-threaded fasteners are fully threaded into the base.

* * * * *